United States Patent [19]

Denton

[11] 4,010,503

[45] Mar. 8, 1977

[54] SHOWER CURTAIN FASTENING DEVICE

[75] Inventor: Ron Denton, Portland, Oreg.

[73] Assignee: The Raymond Lee Organization, Inc., New York, N.Y. ; a part interest

[22] Filed: Feb. 12, 1976

[21] Appl. No.: 657,371

[52] U.S. Cl. ..... 16/87.2; 24/73 PB; 24/16 PB; 248/74 PB

[51] Int. Cl.[2] ..... E05D 13/02

[58] Field of Search ..... 16/87.2, 93, 97; 160/330; 248/74 PB; 24/73 CH, 73 PB, 16 PB, 73 PF, 30.5 P, 208 A

[56] References Cited

UNITED STATES PATENTS

| | | | |
|---|---|---|---|
| 1,244,748 | 10/1917 | Larson | 16/87.2 |
| 2,320,308 | 5/1943 | Silverman | 16/87.2 |
| 2,542,077 | 2/1951 | Gershen | 16/87.2 |
| 2,818,871 | 1/1958 | Beaudry | 24/30.5 P |
| 2,969,216 | 1/1961 | Hallsey | 24/73 PB |
| 2,969,570 | 1/1961 | Petri et al. | 24/16 PB |
| 3,161,929 | 12/1964 | Swett | 24/16 PB X |
| 3,737,943 | 6/1973 | Store | 16/87.2 |
| 3,745,736 | 7/1973 | Fischer et al. | 24/214 UX |

*Primary Examiner*—Andrew V. Kundrat
*Attorney, Agent, or Firm*—Daniel Jay Tick

[57] ABSTRACT

A strip of flexible material of band-like configuration has first and second spaced opposite ends. A hole is formed through the strip in the area of its first end. The strip is adapted to hang over a curtain rod for a shower curtain with its first and second ends in proximity. A fastening member comprising a U-shaped member of resilient material cooperates with the hole through the strip to selectively releasably secure the first and second ends of the strip to each other.

2 Claims, 4 Drawing Figures

SHOWER CURTAIN FASTENING DEVICE

BACKGROUND OF THE INVENTION

The present invention relates to a shower curtain fastening device. More particularly, the invention relates to a shower curtain fastening device for releasably affixing a shower curtain to a shower rod. The shower curtain is of the type having a plurality of spaced holes formed therethrough to facilitate fastening it to the curtain rod.

Objects of the invention are to provide a shower curtain fastening device of simple structure, which is inexpensive in manufacture, used with facility and convenience, and functions efficiently, effectively and reliably to releasably affix a shower curtain to a curtain rod.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
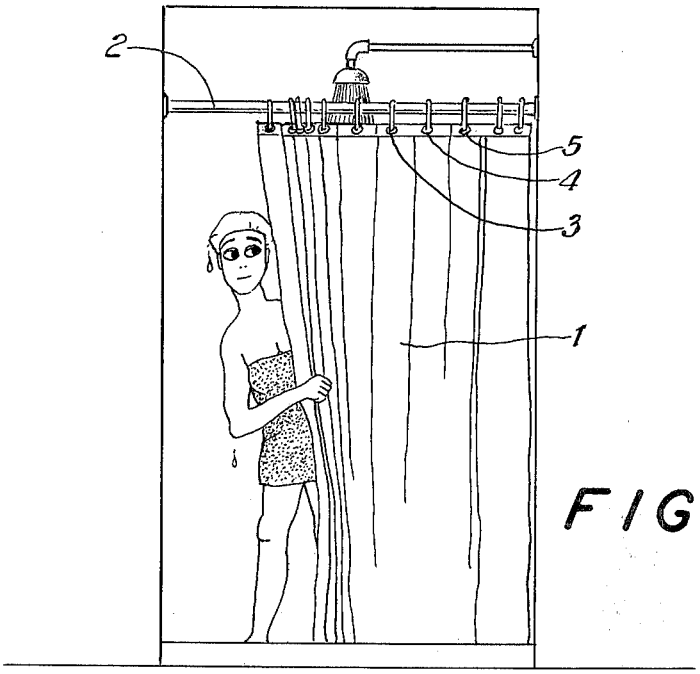
FIG. 1 is a view of a plurality of shower curtain fastening devices of the invention in use.

The shower curtain fastening device of the invention functions to releasably affix a shower curtain 1 to a curtain rod 2, as shown in FIG. 1. The shower curtain 1 has a plurality of spaced holes 3, 4, 5, and so on (FIG. 1) formed therethrough to facilitate fastening it to the curtain rod 2.

Figure 2:
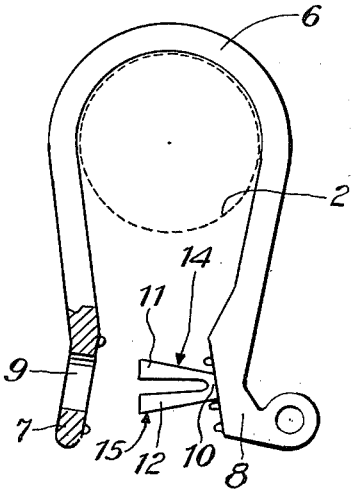
FIG. 2 is a view, on an enlarged scale, partly cutaway, and partly in section, of an embodiment of the shower curtain fastening device of the invention, in its open condition.
Figure 3:
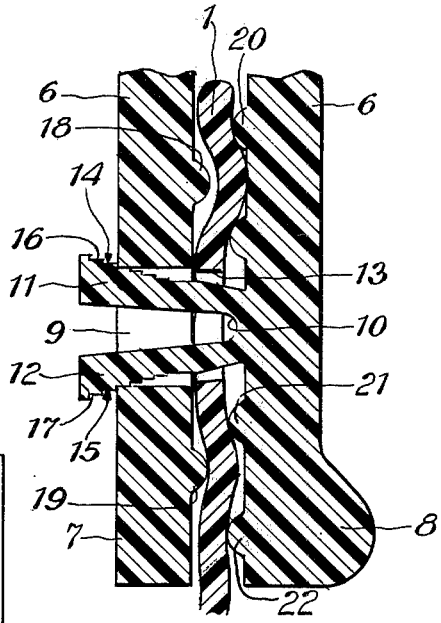
FIG. 3 is a cross-sectional view, on a greatly enlarged scale, of part of the shower curtain fastening device of the invention in its secured condition, releasably affixing a shower curtain to a curtain rod.
Figure 4:
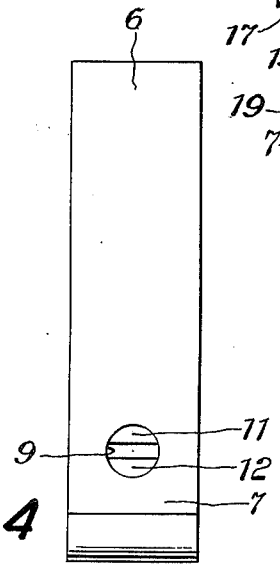
FIG. 4 is a view, on an enlarged scale, of the shower curtain fastening device of the invention.

The shower curtain fastening device of the invention comprises a strip 6 of substantially flexible material of bandlike configuration (FIGS. 2 and 3). The strip 6 may comprise any suitable material such as, for example, plastic, rubber, or the like. A hole 9 (FIGS. 2 to 4) is formed through the strip 6 in the area of its first end. The strip 6 is adapted to hang over a curtain rod 2 for a shower curtain with its first and second ends in proximity, as shown in FIG. 2.

A fastening member comprises a substantially U-shaped member of substantially resilient material having a head 10 affixed to the strip 6 in the area of the second end 8 thereof (FIGS. 2 and 3). The fastening member further comprises a pair of arms 11 and 12 (FIGS. 2 to 4) biased away from each other extending from the head 10 and transversely from the strip 6. Thus, when the arms 11 and 12 of the fastening member are manually pressed toward each other they pass through a hole 13 (FIG. 3) through the shower curtain 1 and the hole 9 through the strip 6. When the arms 11 and 12 are released, they spread apart to secure the fastening member in the hole 9, as shown in FIG. 3.

The arms 11 and 12 of the fastening member have outer opposite surfaces 14 and 15, as shown in FIGS. 2 and 3. A plurality of ridges 16 and 17 are formed in the outer opposite surfaces 14 and 15 of the arms 11 and 12, respectively, of the fastening member for gripping the strip 6 around the hole 9 therethrough, as shown in FIG. 3.

A plurality of spaced projections 18, 19, 20, 21, 22, and so on (FIG. 3) extend from the surface of the strip 6 in the areas of its first and second ends 7 and 8 for enhancing the gripping of the shower curtain 1 by irregularly bending said curtain.

While the invention has been described by means of a specific example and in a specific embodiment, I do not wish to be limited thereto, for obvious modifications will occur to those skilled in the art without departing from the spirit and scope of the invention.

I claim:

1. A shower curtain fastening device for releasably affixing a shower curtain to a curtain rod, said shower curtain having a plurality of spaced holes formed therethrough to facilitate fastening it to the curtain rod, said fastening device comprising a strip of substantially flexible material of band-like configuration having first and second spaced opposite ends, a hole being formed through the strip in the area of its first end, said strip being adapted to hang over a curtain rod for a shower curtain with its first and second ends in proximity; and a fastening member comprising a substantially U-shaped member of substantially resilient material having a head end affixed to the strip in the area of the second end thereof and a pair of arms diverging away from each other and from the head end and transversely from the strip whereby when the arms of the fastening member are manually pressed toward each other they pass through a hole through the shower curtain and the hole through the strip and when said arms are released they spread apart to secure said fastening member in said hole; and wherein the arms of the fastening member have outer opposite surfaces, and a plurality of steps formed on the outer opposite surface of each arm of the fastening member and rising vertically along the axis of the fastening member and with the series of steps on each arm mutually converging toward the head end for gripping the strip around the hole therethrough.

2. A shower curtain fastening device as claimed in claim 1, further comprising a plurality of spaced projections extending from the surface of the strip in the areas of its first and second ends for enhancing the gripping of a shower curtain by irregularly bending said curtain.

* * * * *